US009844271B2

(12) United States Patent
Zager et al.

(10) Patent No.: US 9,844,271 B2
(45) **Date of Patent: *Dec. 19, 2017**

(54) STANDING COMFORT SUPPORT

(71) Applicant: O MY STANDING COMFORT LLC, Flourtown, PA (US)

(72) Inventors: William Zager, Flourtown, PA (US); Paul D'Orazio, Flourtown, PA (US)

(73) Assignee: O MY STANDING COMFORT LLC, Flourtown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/165,063

(22) Filed: May 26, 2016

(65) Prior Publication Data

US 2016/0262545 A1 Sep. 15, 2016

Related U.S. Application Data

(63) Continuation of application No. 14/567,583, filed on Dec. 11, 2014, now abandoned.

(60) Provisional application No. 61/915,763, filed on Dec. 13, 2013.

(51) Int. Cl.

| | |
|---|---|
| ***A47C 7/50*** | (2006.01) |
| ***A47C 9/02*** | (2006.01) |
| ***A47C 16/00*** | (2006.01) |

(52) U.S. Cl.

CPC ..... *A47C 9/025* (2013.01); *A47C 16/005* (2013.01)

(58) Field of Classification Search

USPC ..... 297/19, 21, 22, 24, 42, 16.1, 46, 47, 55, 297/61, 203, 423.1, 900, 195.11, 423.11, 297/423.12, 172; 5/622; 248/398, 161, 248/157, 158, 127

See application file for complete search history.

(56) References Cited

U.S. PATENT DOCUMENTS

| | | | |
|---|---|---|---|
| 4,394,049 | A | 7/1983 | Ward |
| 4,564,237 | A | 1/1986 | Steifensand |
| 4,614,378 | A | 9/1986 | Picou |
| 4,650,249 | A | 3/1987 | Serber |
| 5,149,174 | A | 9/1992 | Charash |
| 5,186,519 | A | 2/1993 | Larson |
| 5,199,763 | A | 4/1993 | Wilder et al. |
| 5,251,961 | A | 10/1993 | Pass |
| 5,401,078 | A | 3/1995 | Riach |
| 5,496,247 | A | 3/1996 | Anderson |

(Continued)

OTHER PUBLICATIONS

MOGO, Focal Upright Furniture, Jan. 1, 2012.

*Primary Examiner* — Terrell McKinnon
*Assistant Examiner* — Michael McDuffie
(74) *Attorney, Agent, or Firm* — Volpe and Koenig, P.C.

(57) ABSTRACT

An adjustable support apparatus including a base with horizontal support members is provided. The adjustable support apparatus includes a first upright support member of a first predetermined height that is supported at one end thereof on one of the horizontal support members, and an other end of the first upright support member has a first support that is generally parallel to the one of the horizontal support members. A second upright support member is supported at one end thereof on a second one of the horizontal support members, and an other end of the second upright support member has a second support that is generally parallel to the second one of the horizontal support members.

13 Claims, 8 Drawing Sheets

(56) References Cited

U.S. PATENT DOCUMENTS

| | | | | |
|---|---|---|---|---|
| 5,697,668 | A | 12/1997 | Chao | |
| 5,971,485 | A | 10/1999 | Clark | |
| 6,397,414 | B1 | 6/2002 | Lloyd | |
| 7,144,080 | B2 | 12/2006 | Lloyd | |
| 7,367,623 | B2 | 5/2008 | Tholkes et al. | |
| 2003/0151277 | A1 | 8/2003 | Chen | |
| 2003/0168899 | A1 | 9/2003 | Voyce, IV | |
| 2006/0082206 | A1 | 4/2006 | Travis | |
| 2007/0182222 | A1 | 8/2007 | Griepentrog | |
| 2010/0201165 | A1 | 8/2010 | Dankovich | |
| 2014/0049087 | A1 | 2/2014 | Kinczkowski | |
| 2015/0164235 | A1* | 6/2015 | Zager ..... | A47C 9/025<br>248/398 |

* cited by examiner

STANDING COMFORT SUPPORT

CROSS REFERENCE TO RELATED APPLICATION

This application claims the benefit of U.S. application Ser. No. 14/567,583, filed on Dec. 11, 2014, which claims the benefit of U.S. Provisional Application No. 61/915,763, filed Dec. 13, 2013, the contents of which are incorporated by reference herein as fully set forth.

FIELD OF INVENTION

This application is generally related to a device for supporting an individual and more particularly related to supporting a standing individual.

BACKGROUND

Many individuals suffer from back pain, which is usually either chronic or injury related. Back pain can be caused by a variety of medical conditions, i.e. strain, herniated discs, sciatica, and spinal stenosis. Back pain can be particularly severe when an individual is sitting in a traditional chair with a flat sitting surface. The flat sitting surface can cause back pain or discomfort.

Recent studies have indicated that sitting for prolonged periods of time, particularly at a desk, can have adverse health effects. Further, other studies have indicated that standing can increase work productivity and efficiency.

Known solutions for addressing lower back pain caused by sitting include exercise ball chairs, lumbar supports, standing desks, kneeling chairs, and reclining chairs. None of these known devices provide both alleviation of pressure on the lower back and a restful support.

SUMMARY

It would be desirable to provide a support device that alleviates lower back pain and is comfortable.

An adjustable support apparatus including a base with horizontal support members is provided. The adjustable support apparatus includes a first upright support member of a first predetermined height that is supported at one end thereof on one of the horizontal support members, and an other end of the first upright support member has a first support that is generally parallel to the one of the horizontal support members. A second upright support member is supported at one end thereof on a second one of the horizontal support members, and an other end of the second upright support member has a second support that is generally parallel to the second one of the horizontal support members.

Preferred arrangements with one or more features of the invention are described below and in the claims.

BRIEF DESCRIPTION OF THE DRAWINGS

The foregoing Summary as well as the following Detailed Description will be best understood when read in conjunction with the appended drawings. In the drawings.

DETAILED DESCRIPTION OF THE PREFERRED EMBODIMENTS

Generally, an adjustable support device is provided that includes a first support member that is generally disposed horizontally, has at least two opposed portions, and is dimensioned to form a base for the adjustable support device. A second support member is attached to one of the two opposed portions at one end and has a free end that it is generally vertically disposed with respect to the first support member. A third support member is attached to at least one of the two opposed portions of the first support member at one end thereof and is configured to support an occupant of the support device at a free end thereof. An adjustment member adjusts the position of the second and third support members relative to each other.

Figure 1:
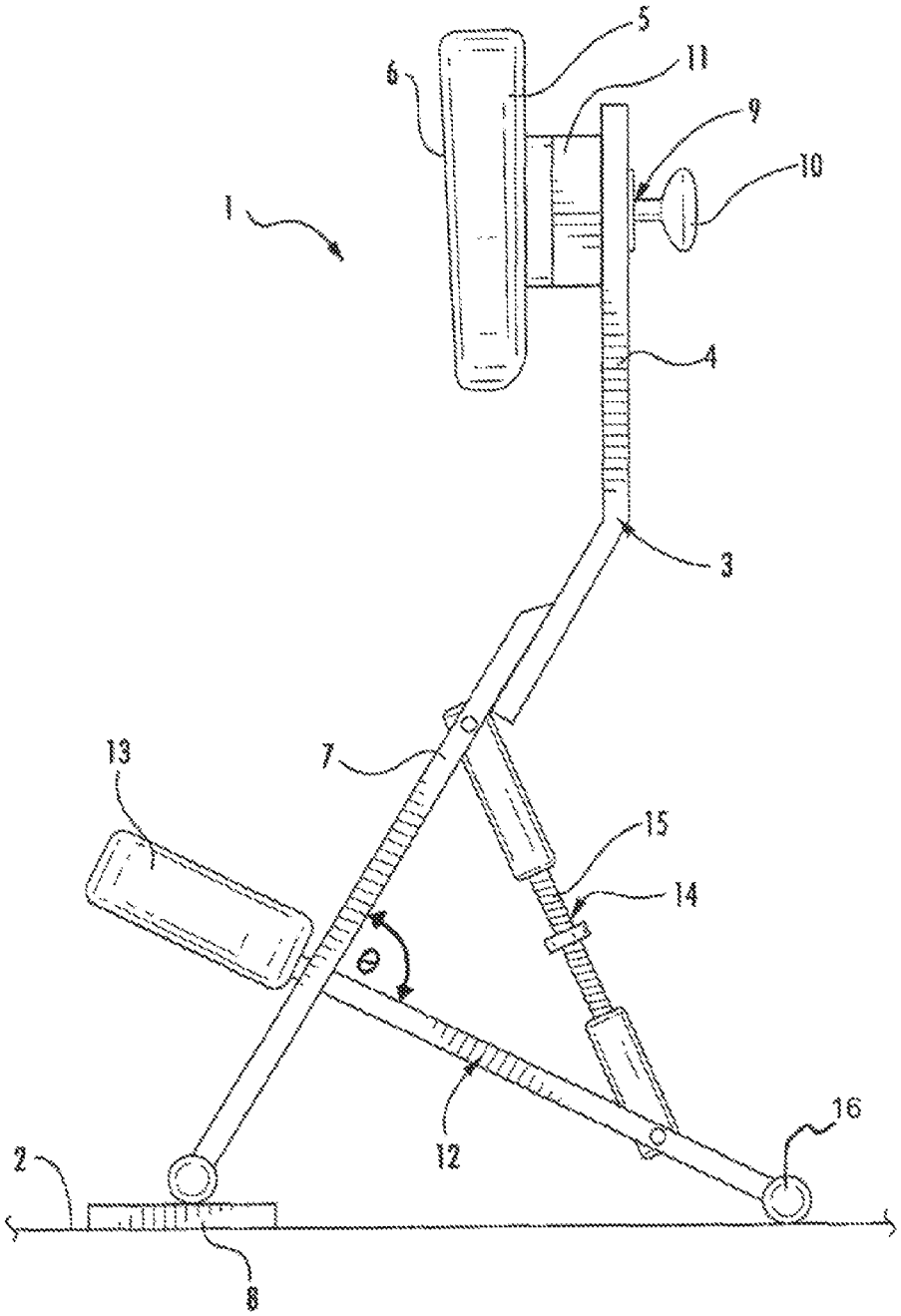
FIG. 1 is side view of an adjustable support device according the present invention.
Figure 2:
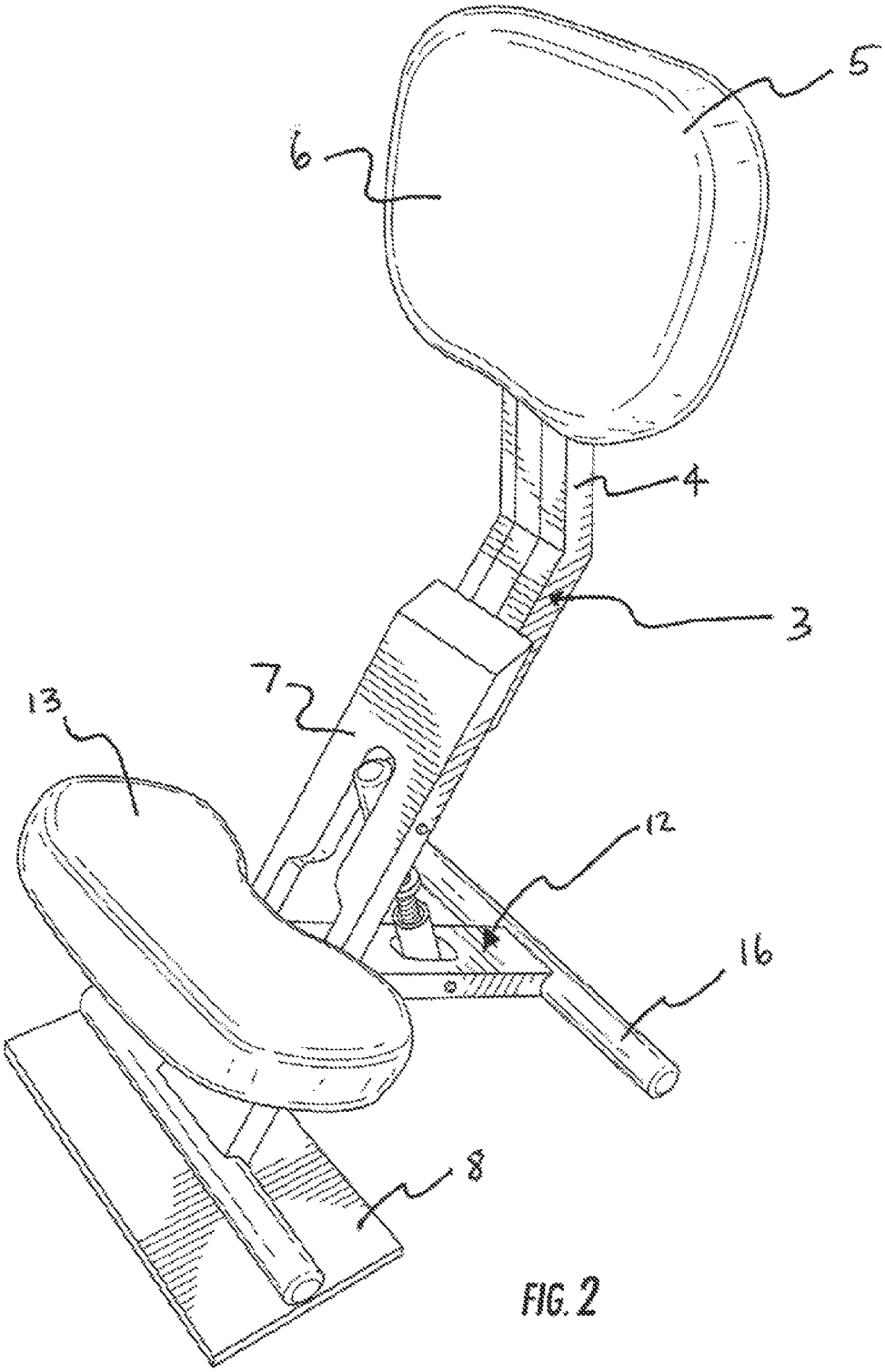
FIG. 2 is a perspective view of the adjustable support device.
Figure 3:
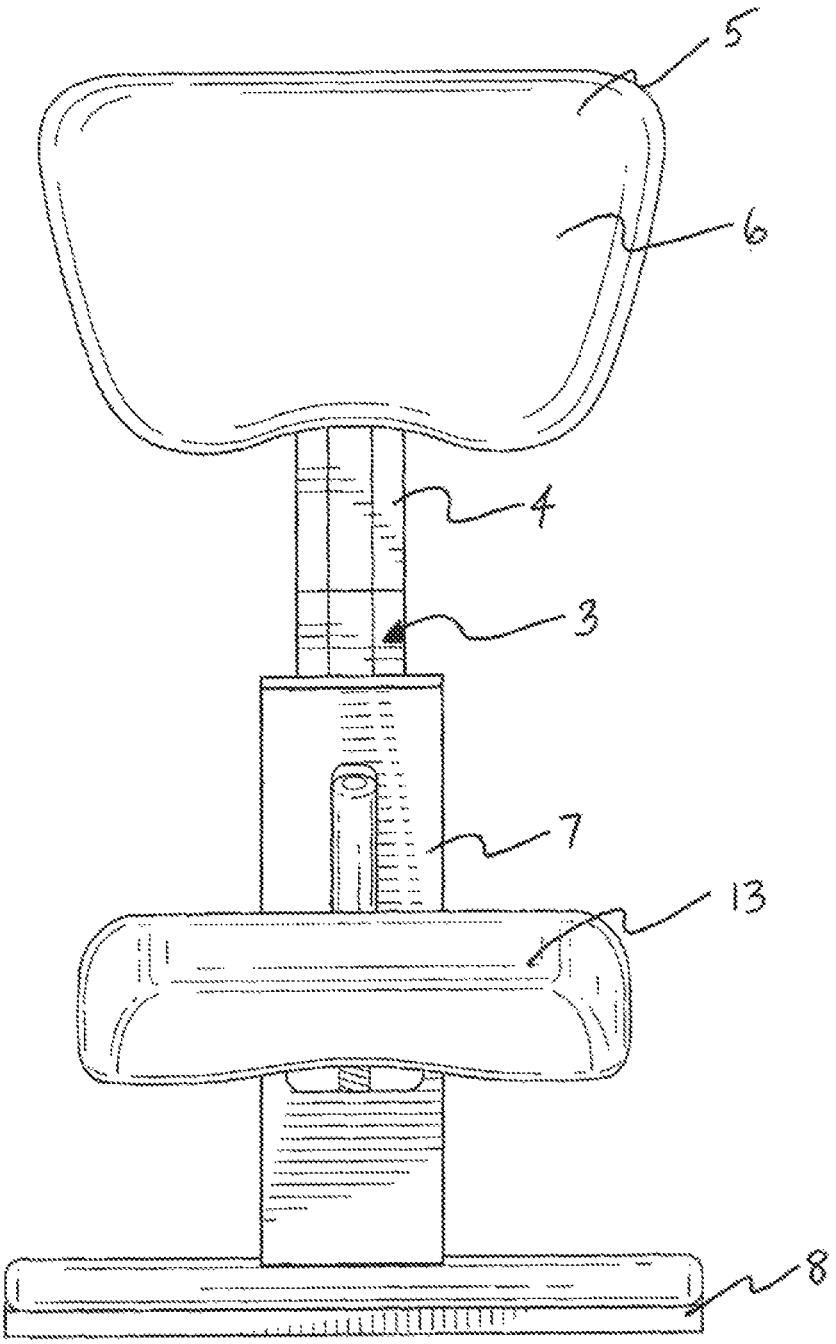
FIG. 3 is a front view of the adjustable support device.

FIGS. 1-3 show a first embodiment of adjustable support device 1 adapted to rest on a ground surface 2. The adjustable support device 1 includes a first frame member 3 including a first portion 4 having a first pad 5 at a first end. The first pad 5 has a support surface 6 arranged substantially perpendicular to the ground surface 2. The first pad 5 is preferably a high density foam. The first pad 5 can be covered by polyester, nylon, or cotton material. The first pad 5 is preferably 18 inches wide and 12 inches long. The first pad 5 is preferably adjustably positioned approximately four feet above the ground surface 2. However, depending on the application, the first pad 5 can be higher or lower with respect to the ground surface 2. The first pad 5 is preferably a half round pad.

A second portion 7 of the first frame member 3 extends from a second end of the first portion 4 and is offset at an acute angle from the first portion, which is preferably approximately 55°. The second portion 7 includes a first ground support 8 with a support surface parallel to the ground surface 2. The first ground support 8 is preferably approximately 22 inches wide and 26 inches long. One of ordinary skill in the art recognizes the dimensions of the ground supports can be changed depending on the particular user.

The first portion 4 includes a first adjustment mechanism 9 for adjusting the first pad 6. The first portion 4 can include a plurality of holes on a surface opposite from the surface 6 that supports the first pad 6. The first adjustment mechanism 9 can include a pin 10 that extends through one of the plurality of holes and that is releasably secured in a receiving hole on the first pad 6 or a mounting member 11. The mounting member 11 can be attached to the first pad 6 and is located between the first portion 4 and the first pad 6. The pin 10 can be removed from the receiving hole of the first pad 6 or the mounting member 11 to adjust the vertical position of the first pad 6. The pin 10 can include a widened end for gripping. The plurality of holes in the first portion 4 are preferably spaced 3 inches apart from each other. The first adjustment mechanism 9 can include any suitable releasable securing mechanism for adjusting the vertical position of the first pad 6, such as a spring loaded pin that can be pulled out of engagement with the receiving hole and one of the plurality of holes.

A second frame member 12 extends through an aperture in the second portion 7 of the first frame member 3. A first end of the second frame member 12 includes a second ground support 16. A second end of the second frame member 12 includes a second pad 13 arranged generally perpendicular to the second portion 7 of the first frame member 3. The second pad 13 is arranged between approximately 80-100° to the second portion 7 of the first frame member 3. The second pad 13 is preferably a circular pad.

A second adjustment mechanism 14 is connected between the first frame member 3 and the second frame member 12. The adjustment mechanism 14 preferably includes an adjustable shaft 15 with a strut having a first end pivotally connected to the first frame member 3 and a second end pivotally connected to the second frame member 12. Those of ordinary skill in the art would recognize any adjustable mechanism capable of being lengthened and shortened could be used. The second adjustment mechanism 14 adjusts an angle θ between the second portion 7 of the first frame member 3 and the second frame member 12. The angle θ is preferably in the range of 55-70°.

Figure 4:
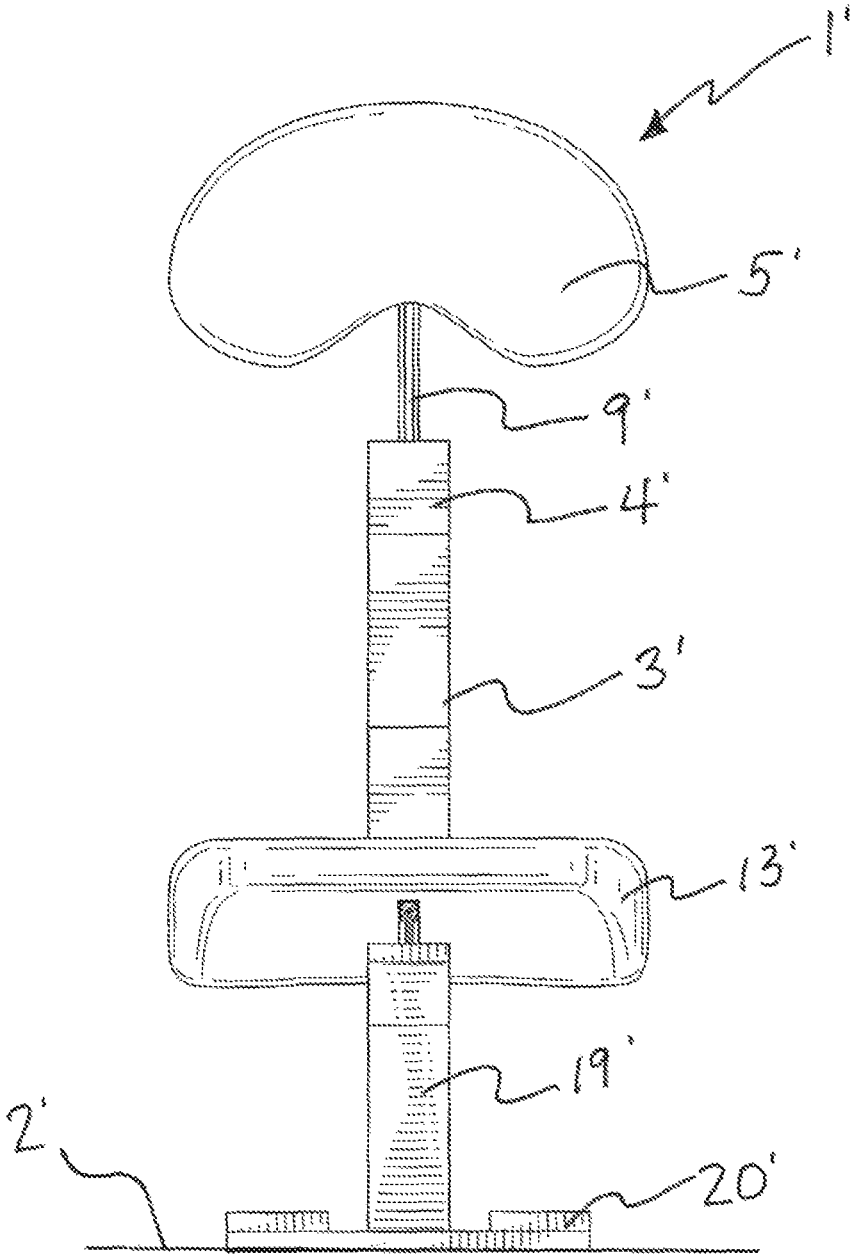
FIG. 4 is a front view of an alternative embodiment of an adjustable support device.
Figure 5:
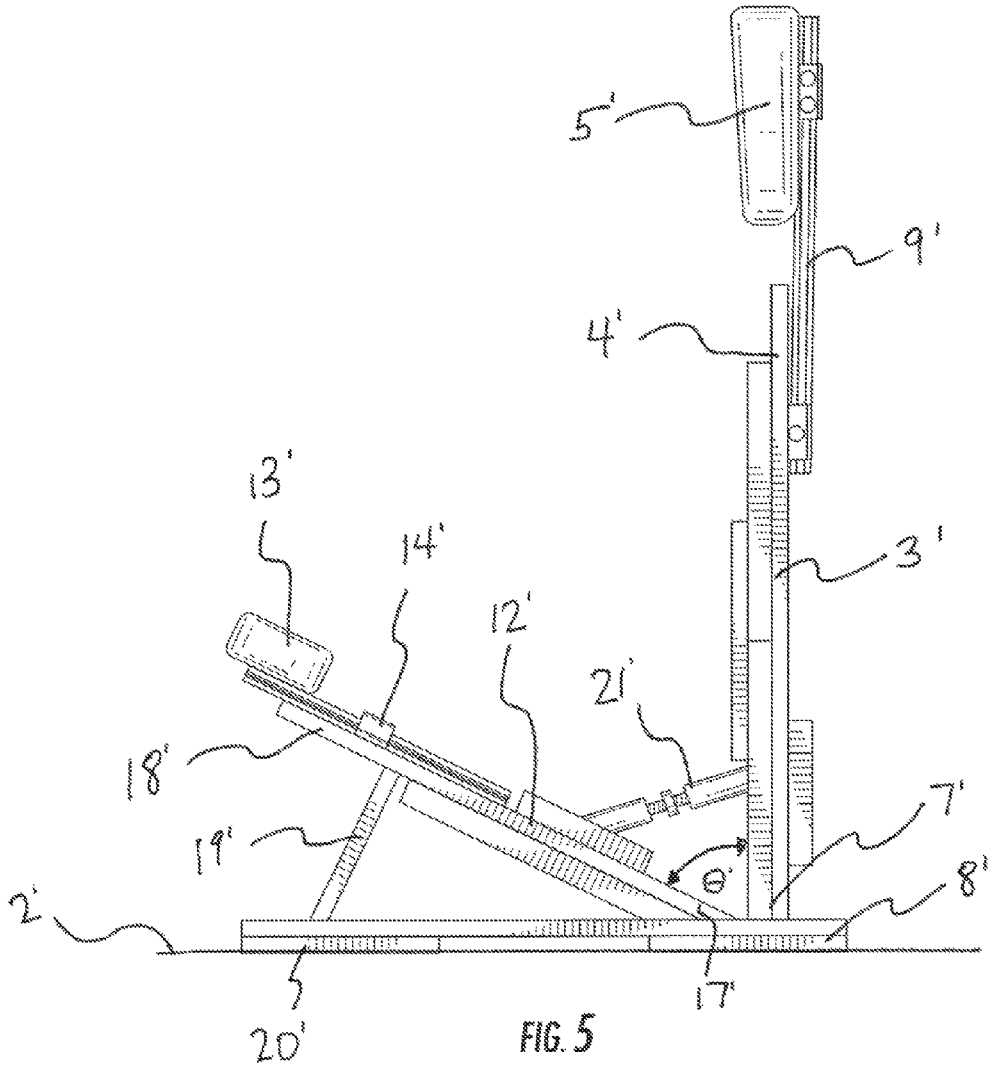
FIG. 5 is a side view of the adjustable support device of FIG. 4.
Figure 6:
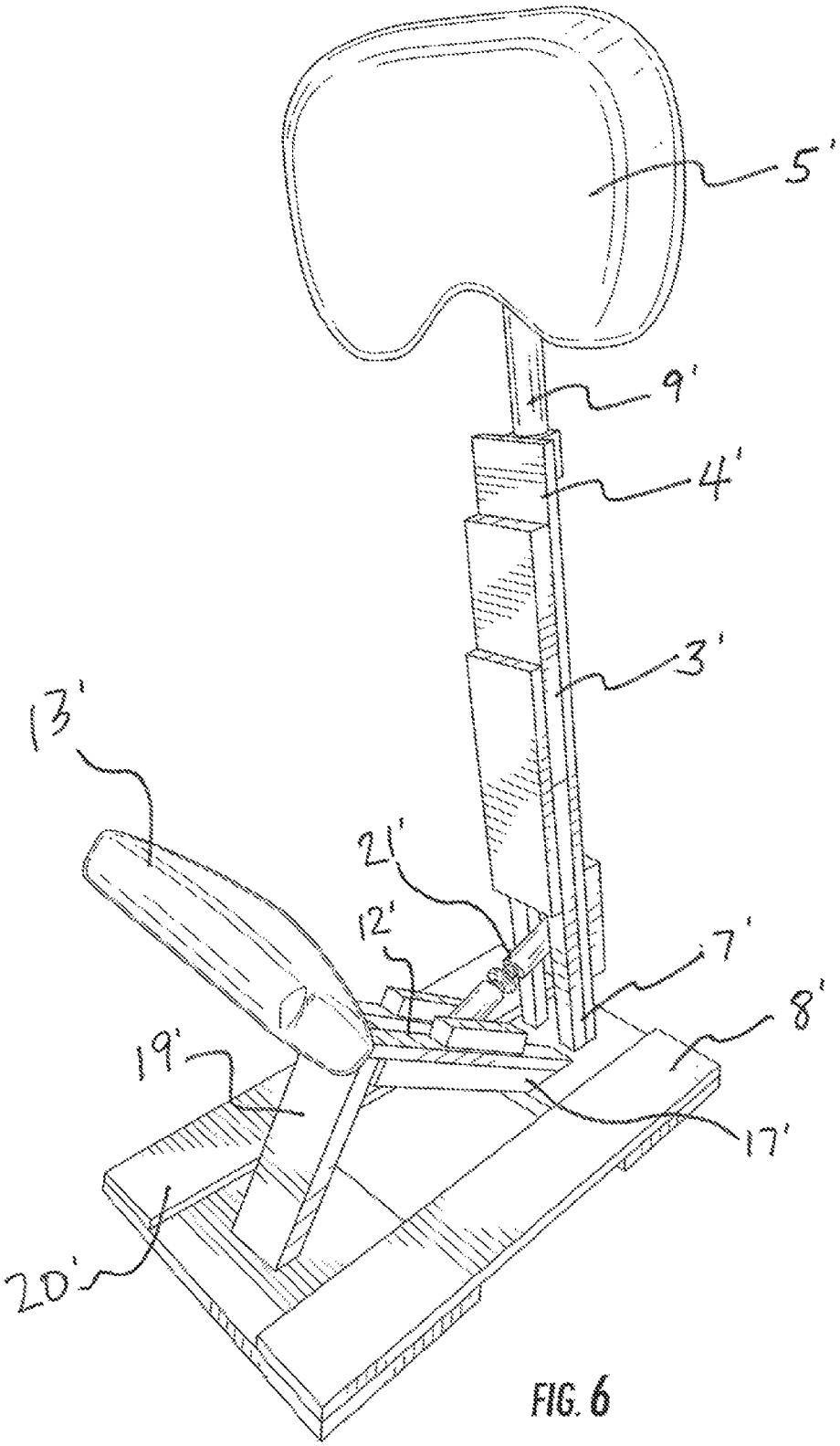
FIG. 6 is a perspective view of the adjustable support device of FIGS. 4 and 5.

A second embodiment of the adjustable support device 1' is shown in FIGS. 4-6. The adjustable support device 1' includes a first frame member 3' including a first end portion 4' with a first adjustment mechanism 9', and a second end portion 7' pivotally fixed to a first ground support 8'. The first adjustment mechanism 9' includes a first pad 5' that has a support surface arranged substantially perpendicular to the ground surface 2'. The first pad 5' is adjustable in a vertical direction and is configured to pivot. A second frame member 12' includes a first portion 17' fixed to the first ground support 8' and a second portion 18' including a second adjustment mechanism 14' including a second pad 13' that is slidably adjustable. The second portion 18' is attached to a third frame member 19' extending from a second ground support 20'. In one embodiment, the first ground support member 8' and the second ground support member 20' are integrally formed. A third adjustment mechanism 21' is connected between the first frame member 3' and the second frame member 12' that adjusts an angle θ' between the first frame member 3' and the second frame member 12'. The first pad 5' can preferably slide 24 inches along the first adjustment mechanism 9'. The second pad 13' can preferably slide 24 inches along the second adjustment mechanism 14'. The angle between the first frame member 3' and the second frame member 12' can preferably be adjusted between 40-60°.

Figure 7:
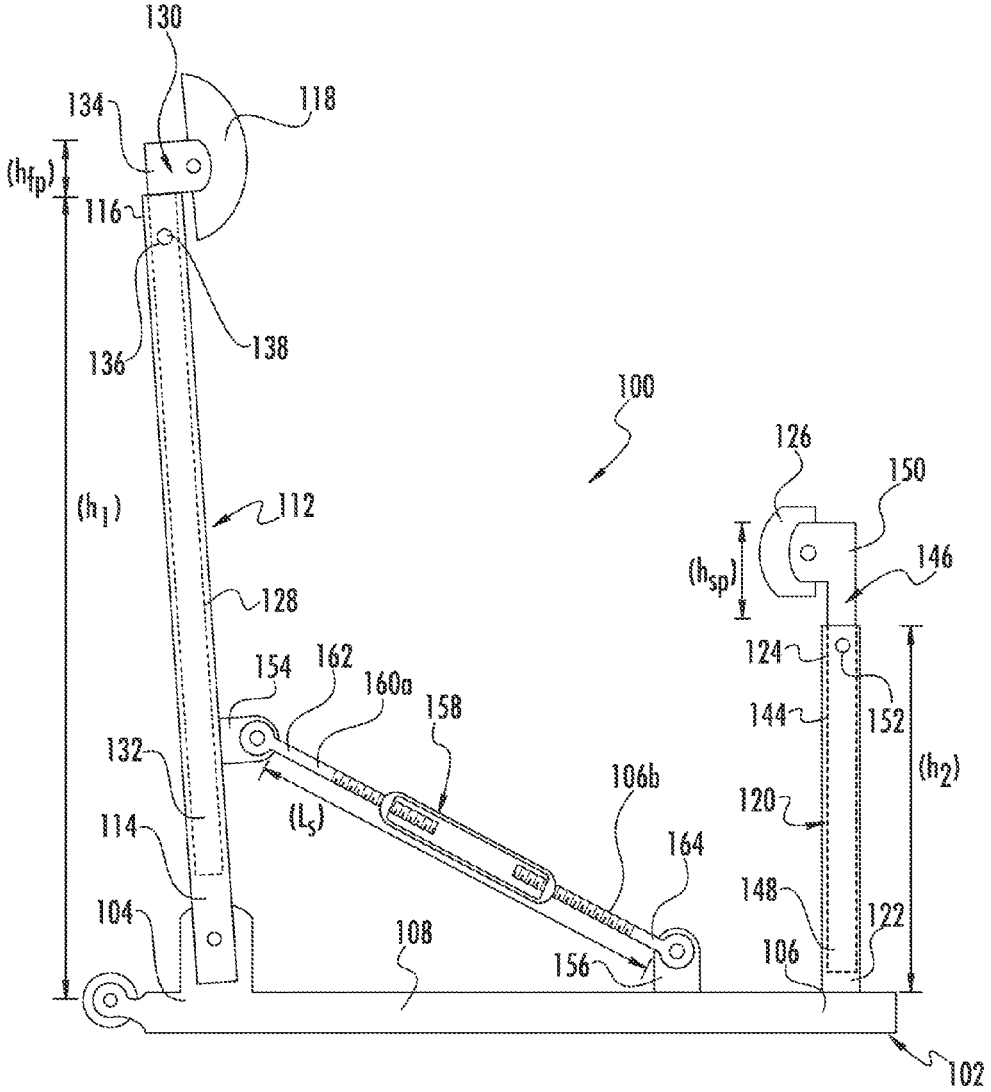
FIG. 7 is a side view of an adjustable support device according to another embodiment.
Figure 8:
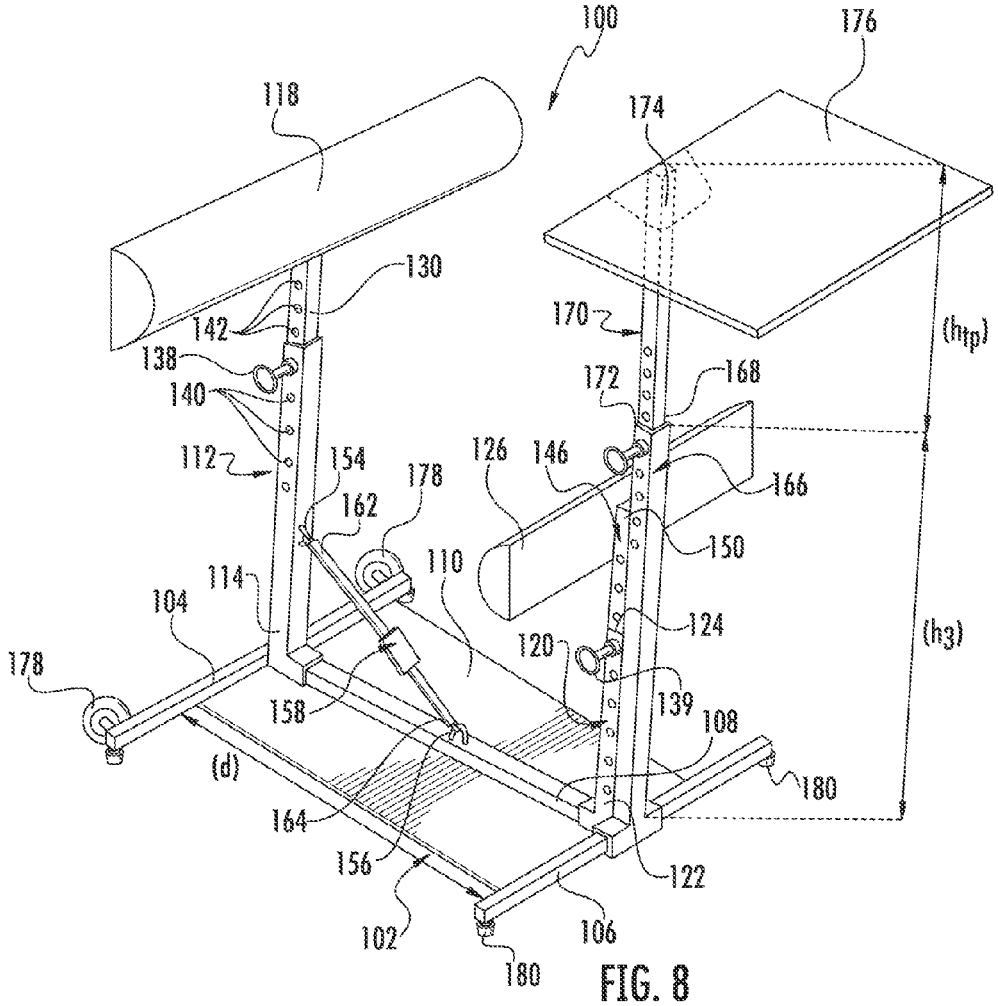
FIG. 8 is a perspective view of an adjustable support device according to another embodiment.

As shown in FIGS. 7 and 8, in another embodiment, an adjustable support apparatus 100 is provided. The adjustable support apparatus 100 includes a base 102 that includes spaced apart horizontal support members 104, 106 that are spaced apart at a predetermined distance (d) by a third horizontal support member 108. The third horizontal support member 108 is preferably 24-36 inches long, and more preferably is 30 inches long. As shown in FIG. 7, in one embodiment, a portion of the third horizontal support member 108 at either end extends beyond the spaced apart horizontal support members 104, 106. In one preferred embodiment, either end of the third horizontal support member 108 extends 2-4 inches beyond each of the spaced apart horizontal support members 104, 106. In another embodiment shown in FIG. 8, the spaced apart horizontal support members 104, 106 are spaced outside of the third horizontal support member 108. A foot plate 110 is connected to the third horizontal support member 108 and disposed between the spaced apart support members 104, 106. In one embodiment, the foot plate 110 includes a bubbled surface, such as an anti-fatigue mat, for distributing and absorbing pressure from a user's feet while standing. In one embodiment, the foot plate 110 extends entirely between the support member 104, 106, and extends the entire length of the third horizontal support member 108. This feature ensures the user's feet do not get caught underneath or tripped on any portion of the foot plate 110. During use, a user places each of their feet on either side of the third horizontal support member 108 and directly onto the foot plate 110. The foot plate 110 is preferably 30 inches long. At least one of the horizontal support members 104, 106 preferably includes wheels 178. In one embodiment, the other one of the at least one of the horizontal support members 104, 106 includes feet support members 180 with rubber ends. In one embodiment, the horizontal support members 104, 106, 108 are formed from square steel tubes. The length and width of the square steel tubes are preferably 1.25 inches each.

A first upright support member 112 of a first predetermined height ($h_1$) that is supported at one end 114 thereof on one of the horizontal support members 104. An other end 116 of the first upright support member 112 has a first support 118 that is generally parallel to the one of the horizontal support members 104. The first support 118 is preferably configured to support a posterior side of a user, such as the back of a user. The first support 118 is preferably formed from foam. In one embodiment, the first support 118 is between 15-20 inches wide and 5-8 inches long. In one preferred embodiment, the first support 118 is 16.5 inches wide and 6.5 inches long. A second upright support member 120 of a second predetermined height ($h_2$) that is less than the first predetermined height ($h_1$), and is supported at one end 122 thereof on a second one of the horizontal support members 106. An other end 124 of the second upright support member 120 has a second support 126 that is generally parallel to the second one of the horizontal support members 106. In one embodiment, the first support 118 and the second support 126 are arranged facing each other. The second support 126 is preferably configured to support a lower extremity of a user, such as the shins of a user. The second support 126 is preferably formed from foam. In one embodiment, the second support 126 is between 15-20 inches wide and 2-5 inches long. In one preferred embodiment, the second support 126 is 16.5 inches wide and 3.5 inches long.

The first upright support member 112 includes a first opening 128 in which a first end 132 of a first post 130 is slidably supported, a second end 134 of the first post 130 is pivotally connected to the first support 118, and a first height ($h_{fp}$) of the first post 130 is adjustable via a first adjustment mechanism 136 with respect to the first upright support member 112. The pivoting connections described herein can include a U-shaped mounting bracket and a pivot pin extending through the U-shaped mounting bracket. The first upright support member 112 is pivotally connected to the one of the horizontal support members 104. The first adjustment mechanism 136 includes a first spring-loaded pin 138, the first upright support member 112 includes a first plurality of holes 140, and the first post 130 includes a first plurality of guide holes 142. In one embodiment, a user pulls the first spring-loaded pin 138 away from the first upright support member 112 and manually moves the first post 130 within the first opening 128. The first upright support member 112 is preferably 50-70 inches tall and the first post 130 is preferably 40-60 inches tall. In one preferred embodiment, the first upright support member 112 is 60 inches tall and the first post 130 is 48 inches tall. In one preferred embodiment, the minimum height of the first upright support member 112 and the first post 130 in its lowest position is approximately 40-60 inches, and is more preferably 60 inches.

The second upright support member 120 includes a second opening 144 in which a first end 148 of a second post 146 is slidably supported, a second end 150 of the second post 146 is pivotally connected to the second support 126, and a second height ($h_{sp}$) of the second post 146 is adjustable via a second adjustment mechanism 152 with respect to the second upright support member 120. The second adjustment mechanism 152 preferably includes a second spring-loaded pin 139, similar to the first spring-loaded pin 138. The second upright support member 120 is preferably 15-25 inches long and the second post 146 is preferably 10-18 inches long. The second upright support member 120 is preferably 20 inches long and the second post 146 is preferably 13 inches long. In one preferred embodiment, the minimum height of the second upright support member 120 and the second post 146 in its lowest position is approximately 10-30 inches, and is more preferably 15-25 inches.

The second upright support member 120 and the second post 146 include a plurality of holes similar to the plurality of holes 140, 142 and similar to the configuration of the first upright support member 112 and the first post 130. In one embodiment, the plurality of holes 140, 142 are spaced one inch apart from each other and each of the plurality of holes 140, 142 includes between 20-40 holes.

The first upright support member 112 includes a first mounting portion 154 and the third horizontal support member 108 includes a base mounting portion 156. A third adjustment mechanism 158 includes at least one adjustment shaft 160 having a first end 162 pivotally connected to the first mounting portion 154, and a second end 164 pivotally connected to the base mounting portion 156, such that a length ($L_s$) of the at least one adjustment shaft 160 is adjustable between the first mounting portion 154 and the base mounting portion 156. The length ($L_s$) adjustments results in the angle between the first upright support member 112 and the third horizontal support member 108. In one embodiment, similar to the one shown in FIG. 1, the at least one adjustment shaft 160 includes a single shaft. In another embodiment, the third adjustment mechanism 158 includes two adjustment shafts 160*a*, 160*b*. In one embodiment, the third adjustment mechanism 158 includes a turnbuckle.

As shown in FIG. 8, a third upright support member 166 is preferably positioned adjacent to the second upright support member 120. The third upright support member 166 includes a third opening 168 in which a first end 172 of a third post 170 is slidably supported, and a second end 174 of the third post 170 includes a pivoting connection to a support surface 176. The second end 174 of the third post 170 is shown in phantom lines in FIG. 8. The support surface 176 is preferably 36 inches wide and 24 inches long. The support surface 176 is configured to serve as a standing desk support surface for a user for items such as a computer, textbooks, etc. The third upright support member 166 preferably has a height ($h_3$) that is less than the height ($h_1$) of the first upright support member 112 and is greater than the height ($h_2$) of the second upright support member 120. The third post 170 has an adjustable height ($h_{tp}$) with respect to the third upright support member 166. In one embodiment, the total minimum height of the support surface 176 is 40 inches. This height is shown in FIG. 8 as the combined height of $h_3$ and $h_{tp}$ and consists of the height of the third upright support member 166 and the third post 170 in its lowest position within the third upright support member 166.

Although the embodiment shown in FIGS. 7 and 8 include manual adjustment mechanisms, in one embodiment, the adjustment mechanisms are automatic or motorized, and include a central control panel for adjusting the height of the various posts within the upright support members. The adjustment mechanism can include an actuator, such as a hydraulic actuator. In another embodiment, a central control panel includes height settings, such as five-feet, six inches, which allows a user to program in their height, and allows the height of the components of the adjustable support device to automatically adjust based on the user's height. The settings can also adjust the degree of offset between the first upright support member 112 and the support member 108 via the adjustment mechanism 158.

All of the pivoting connections between the components described above allow the components to fold into one another, allowing the entire adjustable support device to be folded compactly in place.

Although the materials for specific components have been described above, one of ordinary skill in the art recognizes that the material for all of the components can alternate. In one embodiment, the components for the base 102 can be formed from steel, wood, or plastic. In one embodiment, the components for the upright members 112, 120, and 170 can also be formed from steel, wood, or plastic.

In use, the user places their feet on the foot plate 110 and rests their back against first support 118. The user raises the first post 130 within the first opening 128 of the first upright support member 112 and uses the first adjustment mechanism 136 to adjust the height of the first post 130 within the first upright support member 112. The user can adjust the angle of the first upright support member 112 with respect to the base 102 via the third adjustment mechanism 158. The user rests their shins against the second support 126. The user performs a similar adjustment of the second post 146 within the second upright support member 120 as described above with respect to the first adjustment mechanism 136.

Having thus described various embodiments of the present adjustable support device in detail, it will be appreciated and apparent to those skilled in the art that many changes, only a few of which are exemplified in the detailed description above, could be made in the adjustable support device according to the invention without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. An adjustable support apparatus comprising:

a base that includes;

a first upright support member of a first predetermined height that is supported at one end thereof on a first end of the foot plate, an other end of the first upright support member has a first support, the first upright support member includes a first opening in which a first end of a first post is slidably supported, a second end of the first post is pivotally connected to the first support, and a first height of the first post is adjustable via a first adjustment mechanism with respect to the first upright support member;

a second upright support member of a second predetermined height that is less than the first predetermined height, and is supported at one end thereof on a second end of the foot plate, an other end of the second upright support member has a second support, the second upright support member includes a second opening in which a first end of a second post is slidably supported, a second end of the second post is connected to the second support, and a second height of the second post is adjustable via a second adjustment mechanism with respect to the second upright support member; and a third upright support member positioned adjacent to the second upright support member, wherein the third upright support member includes a third opening in which a first end of a third post is slidably supported, a second end of the third post includes a pivoting connection to a support surface, and the support surface and the pivoting connection are positioned vertically above the second support.

2. The adjustable support apparatus of claim 1, wherein the support surface is a rectangular, rigid workstation support surface.

3. The adjustable support apparatus of claim 1, wherein the support surface is 36 inches wide and 24 inches long.

4. The adjustable support apparatus of claim 1, wherein the support surface is dimensioned to support a computer or textbook.

5. The adjustable support apparatus of claim 1, wherein the support surface has a minimum height of 40 inches.

6. The adjustable support apparatus of claim 1, wherein the first adjustment mechanism includes a first spring-loaded pin, the first upright support member includes a first plurality of holes for the first spring-loaded pin, and the first post includes a first plurality of guide holes.

7. The adjustable support apparatus of claim 1, wherein the first support and the second support are arranged facing each other.

8. The adjustable support apparatus of claim 1, wherein the first support is configured to support a posterior side of a user.

9. The adjustable support apparatus of claim 1, wherein the second support is configured to support a lower extremity of a user.

10. The adjustable support apparatus of claim 1, wherein the third opening of the third upright support member is positioned vertically above the second support.

11. An adjustable support apparatus comprising:

a base that includes;

a first upright support member of a first predetermined height that is supported at one end thereof on a first end of the foot plate, an other end of the first upright support member has a first support, the first upright support member includes a first opening in which a first end of a first post is slidably supported, a second end of the first post is pivotally connected to the first support, a first height of the first post is adjustable via a first adjustment mechanism with respect to the first upright support member, and the first support is configured to support a posterior side of a user;

a second upright support member of a second predetermined height that is less than the first predetermined height, and is supported at one end thereof on a second end of the foot plate, an other end of the second upright support member has a second support, the second upright support member includes a second opening in which a first end of a second post is slidably supported, a second end of the second post is connected to the second support, a second height of the second post is adjustable via a second adjustment mechanism with respect to the second upright support member, and the second support is configured to support a lower extremity of a user; and a third upright support member positioned adjacent to the second upright support member, wherein the third upright support member includes a third opening in which a first end of a third post is slidably supported, a second end of the third post includes a pivoting connection to a support surface, the support surface is a rectangular, rigid workstation support surface, and the support surface and the pivoting connection are both positioned vertically above the second support.

12. The adjustable support apparatus of claim 11, wherein the support surface extends in a forward direction away from the base.

13. The adjustable support apparatus of claim 12, wherein the support surface extends generally parallel to the base.

* * * * *